US007594305B2

(12) United States Patent
Moore

(10) Patent No.: US 7,594,305 B2
(45) Date of Patent: Sep. 29, 2009

(54) SOCKET ENGAGING TETHER FOR ELECTRONIC DEVICES

(76) Inventor: Christopher Moore, 2246 Caminito Preciosa Sur, La Jolla, CA (US) 92037

( * ) Notice: Subject to any disclaimer, the term of this patent is extended or adjusted under 35 U.S.C. 154(b) by 390 days.

(21) Appl. No.: 11/034,428

(22) Filed: Jan. 11, 2005

(65) Prior Publication Data

US 2006/0150375 A1 Jul. 13, 2006

(51) Int. Cl.
*A44B 21/00* (2006.01)

(52) U.S. Cl. ..... 24/299; 24/3.13

(58) Field of Classification Search ..... 24/3.1, 24/3.4, 3.11–3.13, 671–676; 16/406, 422, 16/428

See application file for complete search history.

(56) References Cited

U.S. PATENT DOCUMENTS

| | | | | | |
|---|---|---|---|---|---|
| 2,285,000 | A | * | 6/1942 | Wallace | 24/10 R |
| 3,777,639 | A | * | 12/1973 | Lange | 396/541 |
| 4,304,403 | A | * | 12/1981 | Wilson | 24/310 |
| 4,828,153 | A | * | 5/1989 | Guzik et al. | 224/242 |
| 4,881,256 | A | * | 11/1989 | Malekos | 379/449 |
| 4,901,355 | A | | 2/1990 | Moore | |
| 5,045,871 | A | * | 9/1991 | Reinholdson | 396/6 |
| 5,127,137 | A | * | 7/1992 | Krauss | 24/265 R |
| 5,709,012 | A | | 1/1998 | Ebashi | |
| 5,740,952 | A | * | 4/1998 | Huckenbeck | 24/3.11 |
| 5,906,031 | A | * | 5/1999 | Jensen | 24/3.12 |
| 5,938,137 | A | | 8/1999 | Poulson | |
| 5,971,242 | A | | 10/1999 | Schuerman | |
| 6,134,388 | A | * | 10/2000 | Balling et al. | 396/6 |
| 6,141,835 | A | * | 11/2000 | Wilson | 24/68 E |
| 6,241,631 | B1 | * | 6/2001 | Wilson | 473/502 |
| 6,244,778 | B1 | * | 6/2001 | Chesbrough | 403/51 |
| 6,252,555 | B1 | * | 6/2001 | Burton | 343/702 |
| 6,304,221 | B1 | * | 10/2001 | Brown | 224/197 |
| 6,352,186 | B1 | | 3/2002 | Endo | |
| 6,374,468 | B1 | * | 4/2002 | Cardwell et al. | 24/584.1 |
| 6,379,178 | B1 | | 4/2002 | Jones, III et al. | |
| 6,427,374 | B1 | | 8/2002 | Valani | |
| 6,487,756 | B1 | * | 12/2002 | Vidal, Jr. | 24/3.1 |
| 6,513,201 | B2 | * | 2/2003 | Beune et al. | 24/3.2 |
| 6,584,655 | B1 | * | 7/2003 | Cardwell et al. | 24/643 |
| 6,626,389 | B2 | | 9/2003 | Kegel | |
| 6,662,986 | B2 | | 12/2003 | Lehtonen | |
| 6,725,506 | B1 | * | 4/2004 | Anscher | 24/3.4 |
| 6,883,694 | B2 | * | 4/2005 | Abelow | 24/3.13 |
| 2001/0032868 | A1 | | 10/2001 | Callahan | |
| 2003/0019893 | A1 | | 1/2003 | Decoteau | |
| 2003/0033697 | A1 | * | 2/2003 | Hicks et al. | 24/3.13 |
| 2003/0042348 | A1 | | 3/2003 | Salentine et al. | |
| 2003/0224677 | A1 | | 12/2003 | Hart | |
| 2005/0199672 | A1 | * | 9/2005 | Abelow | 224/666 |

* cited by examiner

*Primary Examiner*—Robert J Sandy
(74) *Attorney, Agent, or Firm*—Donn K. Harms

(57) ABSTRACT

A tether for electronic devices employing a plug having a first end adapted for engagement to a tether and a second end formed on non-conductive material having an exterior surface with an exterior circumference adapted for frictional engagement with the interior circumference of an electrical socket. The second end can be formed of compressible material having an exterior circumference slightly larger than the socket for a biased engagement. An axial void can also be provided to accommodate projections in the socket or to engage an antenna.

11 Claims, 1 Drawing Sheet

SOCKET ENGAGING TETHER FOR ELECTRONIC DEVICES

FIELD OF THE INVENTION

The apparatus herein disclosed relates to a tethering device for electronic components. More particularly it relates to a device for securing such electronic devices to an individual by employing a non-conductive plug that mechanically engages with electronic components of the device itself. The device includes a plug having a first end for attachment to a tethering assembly or other security mechanism and a second end for attachment through compressive frictional force to a concavity within or an extension upon an electronic or other device. Such an engagement is achieved in all cases without adversely affecting any of the functional electronic characteristics of the device during use. Examples of such devices include but are not limited to cellular phones, pagers, cd players, PDA's, radios, calculators, flashlights, key chains, stun guns and the like which have electronic sockets or antennas engageable by the disclosed device herein.

BACKGROUND OF THE INVENTION

Humans have always carried and used handheld devices to provide or enhance various capabilities to their users. From axes, knives and pistols to provide protection, to compasses, sundials and mirrors to provide guidance and communication, such handheld devices have been synonymous with mankind's technical progress over the ages.

Over time such articles have evolved to include more complex devices based upon providing similar benefits through electronic means. In the modern world, there has been a significant proliferation of such personal electronic devices such as phones, radios, pagers, PDA's, door locks, and calculators. In addition, sport, military and application specific products such as night vision devices, radar guns, heat detectors, global positioning systems, compasses and the like have shared this dramatic explosion of growth. Such devices when properly used enable individuals to perform their jobs or enjoy their pastimes more effectively and the secured possession of such a device properly utilized could even help save that person's or another's life.

A long standing problem has been the secure retention by the user of these devices during common or strenuous use and especially during dangerous or emergency activities. This is an ever-evolving problem as such electronic devices become ever-smaller in physical dimension rendering them easily misplaced or forgotten. Additionally, the replacement cost, efficacy of the device, user and citizen safety can be adversely affected by potential loss, misappropriation or damage. Under adverse circumstances the very life and limb of the users and associates could be jeopardized by loss of an essential electronic item.

In ancient times such tools were secured to the user to prevent loss or damage by simple means such as a rope or piece of leather thong tied to both the device and the user, a method used even today in some circumstances. Today's users of electronic devices continue to share the same critical requirement for security and loss prevention or to preclude misappropriation or damage to their property. A number of methodologies have been employed to resolve this issue as noted below. Some methods employ elegant mechanical devices to effect attachment and others are logical extensions of the basic piece of rope or leather thong.

Numerous previous solutions, some noted below, generally involve a tether or lanyard assembly that is attached to both the user via a clip or hook and physically to the device. Until now; however, all solutions can only effect their attachment methodology through some purpose-built attachment point designed into the device itself. There has existed a long felt need for the capability to ensure device constraint that would be simply applied, universally available, and would not require any material modification to the device to be constrained. Such a device would be especially useful for restraint of electronic devices lacking a mount or attachment point for a restraint. The present invention fulfills this long felt need.

PRIOR ART

A typical example of a device is U.S. Publication 2003/0042348 (Salentine) which discloses such a device, incorporating a retracting tether. Though useful, this device demonstrates what shall be seen to be a recurring flaw in all preceding designs. In this representative example as drawn, the device has two ends. One end is attached to a belt clipped retracting tether device and one end is attached to the item to be secured. The obvious flaw in this approach is that the item to be secured must possess a suitable "manufactured in" surface or structure to provide the device attachment point for a ring or loop to permit the attachment to the retractable lanyard assembly.

Another approach to a solution is U.S. Publication 2003/0019893 (Decoteau) which discloses a method for holding a handheld object. This approach involves a tethering device with two ends including an end to be attached to the device and an end to be attached to the wearer via a belt clipped retracting tether. The means of attachment in this example is proposed through either the application of adhesives or through mechanical devices such as screws or nuts and bolts and this is the design's obvious shortcoming. Mechanical devices would require appropriate means to effect their utilization. The flaw here is that suitable apertures to accept mechanical screws would need to be drilled by the user or provided by the manufacturer in the basic design when manufactured at increased cost. The liabilities associated with the user personally modifying an electronic device by drilling it are predictable.

The shortcomings of the second method proposed, adhesives, are that they can permanently affect the surface of the device, they tend to be sporadic in the effectivity of their adhesive qualities based on the abilities of the person applying them and, as well, those adhesive qualities are often adversely affected by even moderate temperature fluctuations.

U.S. Pat. No. 5,709,012 (Ebashi) discloses a design of a belt clip integrated with a structure intended to receive a lanyard composed of a ball-type chain and clips. The device features a number of molded resin and metal components comprising a mechanical clamp dimensioned to be compressed onto an electronic device and retained in conjunction with it through the means of an eye and bolt type fastening molded either into or onto the electronic device itself. Though this implementation resolves both the problems noted in the examples above, it engenders another more significant negative property: it can only be used on devices which are created to accept it. As a result, generic interchangeability with other potential devices to be secured would be limited to only those devices of manufacturers adopting the technology, thus severely limiting overall functionality.

U.S. Pat. No. 6,352,186 B1 discloses a method of securing electronic devices, specifically cell phones, through means of a wire tether, a belt fastening clip and a receiving clip assembly encased within and transversing a channel molded into the body of the secured device. Though this method solves some of the issues noted above, it is flawed in that it too is a device specific implementation requiring that the device to be secured be designed from its inception to accommodate the necessary hardware.

As such there exists a pressing need for a tether device that will secure small and valuable electronic devices to their user to prevent damage from dropping or loss from inadvertent leaving of the device or theft. Such a device should provide an easy engagement and disengagement of the electronic component from the tether to allow the user to disengage it. Such a device should provide for attachment to the tether without the need for structural mounts on the electronic device. Such a device should be easily employable to a wide variety of electronic components thereby allowing the user to attach one device to himself and a wide variety of different electronic components.

SUMMARY OF THE INVENTION

The present invention provides a means for a user to secure electronic articles to his person through socket based compressive frictional engagement. The disclosed device herein easily engages with electronic devices using already available electronic jacks, sockets, receptacles or other orifices, concavities or extensions-like antennae that are already readily present in or on conventional electronic devices as provided by the manufacturer. The device allows for easy engagement and disengagement to a wide variety of electronic devices without modifications to the device itself or the need for any other component to encase the electronic device being secured.

The device features an elongated plug with two ends of varying shape and dimensions, the second end of which is dimensioned for cooperative engagement with a socket or antenna on the electronic apparatus to be restrained using the shape of the receptacle, concavity or extension already available.

The first end of the plug is adapted to facilitate communication between the plug and tether or lanyard assembly which may be coiled, spring-loaded or neither and which employs suitable means for engagement to items and users such as key rings, spring clips, snaps or knots or hook and loop materials.

The plug has a second end which is non-conductive and is dimensioned about the distal end circumference to provide frictional engagement within the interior wall of the elongated socket, receptacle, exterior communicating socket connector of an electronic device. The second end may also be configured in varying embodiments, all of which are non-conductive, to engage a conventional extension from the electronic device such as an antenna communicating with the exterior surface of an electronic device. Or it can also be configured to engage both the antenna and a cavity style socket in the electronic device.

In a preferred mode of the device, the elongated plug is formed from non-electrically conductive, non-radio-reflective material such as plastic to eliminate interference or dysfunctional interaction with electronic functions of the electronic component while the plug is frictionally engaged within the recessed receptacle of the electronic component or cooperatively engaged to its antenna or other extension. When engaged in a charging socket, the device being non-conductive will allow use of the electronic device while still being restrained by the tether.

In the preferred mode of the device, the plug is also preferably manufactured from a resilient compressible material such as plastic, silicon, or rubber. When inserted in the appropriate aperture or over an extension, the plug is compressed by the sidewalls of the recess to provide a biased engagement generated by the frictional force toward the sidewalls by the compressed material, thereby holding the plug firmly in place. Other modes include two-ended electronically functional or non-functional metallic or composite plugs demonstrating the previously noted end configurations, required frictional attributes and secure object retentive functionality.

With respect to the above description, before explaining at least one preferred embodiment of the invention in detail, it is to be understood that the invention is not limited in its application to the details of construction and to the arrangement of the components or steps set forth in the following description or illustrated in the drawings, nor just to electronic devices. The apparatus and methods of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the objects and claims be regarded as including such equivalent construction and methodology insofar as they do not depart from the spirit and scope of the present invention.

Further objectives of this invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF PREFERRED EMBODIMENTS OF THE DISCLOSED DEVICE

Figure 1:
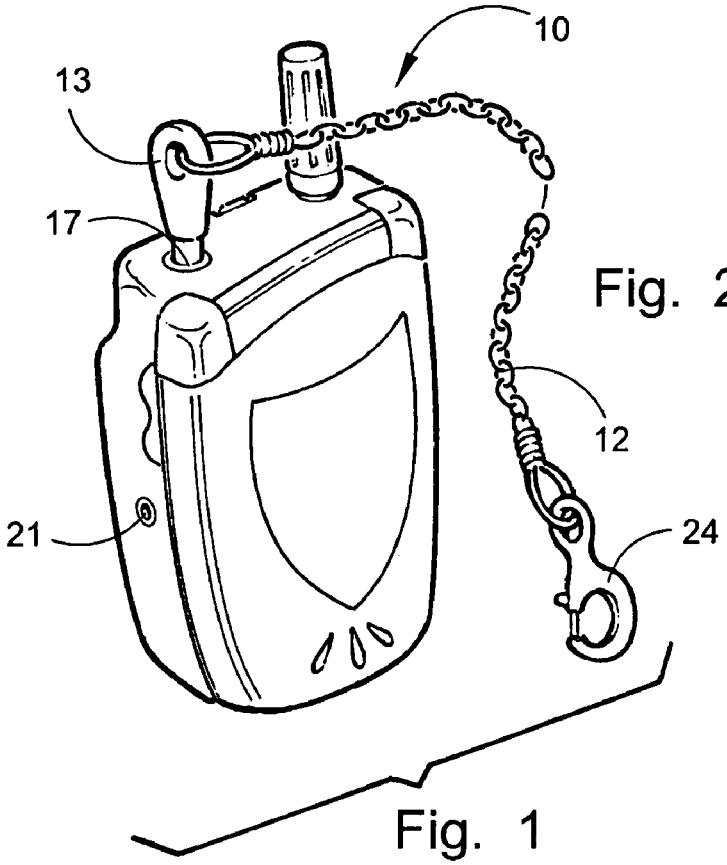
FIG. 1 depicts the device adapted for engagement with a socket on a conventional cell phone.

Referring now to the drawings FIGS. 1-5 which disclose the preferred embodiments of the herein disclosed device, the present invention is defined in the description which follows in reference to the noted plurality of drawings by way of non-limiting examples of embodiments of the present invention in which like reference numerals represent similar parts throughout the several views of the drawings.

In FIG. 1 there is depicted an engaged perspective view of the disclosed device 10. The device 10 in this embodiment and all other embodiments feature a tether 12 which may be straight, coiled or spring-loaded. A first end 13 of the plug 14 is protruding from the engagement with a cell phone or other electronic device having a port engageable with the device 10. At the second end 15 of the plug 14 is a preferably non-conductive compressive socket insert adapted for frictional engagement with one of a socket 17 or protruding antenna 19 of any portable electronic device having an engageable socket 17 in the body or protruding antenna 19 or the like such as a cell phone or PDA or portable music player. Most such devices almost always employ a ⅛ inch recess style socket 17 or a battery charging socket 21 which communicate with the exterior of the case of the electronic component. Consequently the device 10 is especially well adapted for engagement with and retainment of any of the multitude of such electronic devices available with charging ports or earphone ports or similar recess style ports communicating with the exterior of the case in which they reside.

Figure 2:
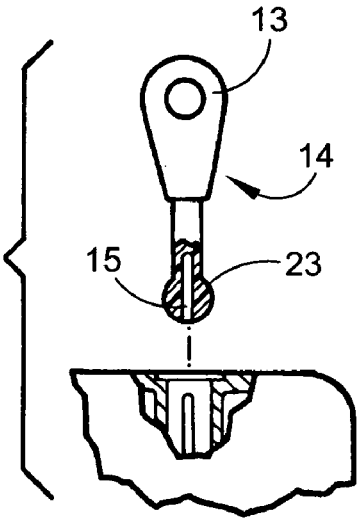
FIG. 2 is a side cut away of the device adapted for engagement with a charging port on a conventional electronic device.

FIG. 2 depicts an embodiment of the device 10 especially well adapted for insertion into either a charging socket 21 which conventionally has a axially located center post surrounded by a sidewall or an earphone or speaker style socket 17 which has a sidewall and depressable contact which in some cases acts as a switch to turn of the speaker of the electronic component. The embodiment shown in FIG. 2 has a second end 15 that is a male version of a plug 14 designed to be in communication with the power, earphone or other socket on an electronic device with a central post type receptacle or sidewall and displays a first end 13 for engagement to a tether 12. The second end 15 of all embodiments is best made of plastic, rubber, or other non-conductive materials to isolate the device 10 from the electrical circuit of the socket 17. The provision of a bulbous spherical or boule shaped second end 14 will also provide the necessary restrictive friction within the socket by biasing against the sidewalls of the socket when compressed therein. In most cases the circumference of the exterior of the second end 15 whether it is bulbous as in FIG. 2 for cylindrical as in FIG. 3, will be slightly larger than the circumference of the socket in which it is engaged. This provides for a slight compression and resulting biasing of the exterior of the second end 15 against the sidewall defining the socket.

Figure 3:
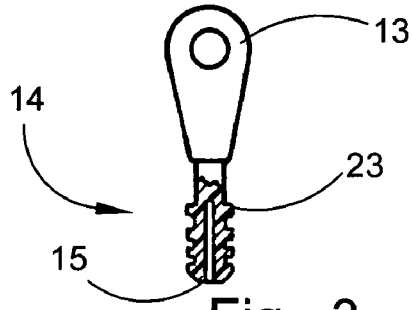
FIG. 3 is a side cutaway view of another embodiment of the device adapted for engagement with a port of an electrical device.

FIG. 3 depicts another preferred embodiment shown in a cut away side view of a male version of a plug 14 designed to be in communication with the power, earphone or other socket on an electronic device containing a central axially located post type void 23 and displays the first end 13 adapted for engagement to a tether 12. The axial void 23 present within the plug 14 will allow for the plug 14 to be inserted into power sockets with an axially disposed center post. The ferrule shaped second end 15 may also be striated about its exterior circumference for better frictional engagement with the wall forming the socket. This would allow the exterior circumference to be substantially equal in size to the interior circumference of the socket in which it engages and still achieve a good fictional engagement with it, or as noted above, the exterior circumference of the second end 15 could be slightly larger and in compressed engagement with the socket and have the additional holding power of the striated surface.

FIGS. 2 and three also show the second end 15 of a plug 14 adapted to accommodate axially disposed socket components showing the axially disposed void 23. It should be noted that the plug 14 could either have this void 23 in combination with any of the various exterior circumference shapes to allow the plug to fit in any earphone or power style socket, or the various second ends 15 could be adapted solely for power sockets or earphone or speaker socket. Or, in a currently preferred mode of the device 10 which would be especially useful, the plug 14 could be provided in kit form. In the kit would be a plurality of differently dimensioned second ends 15 which are adapted for engagement to the first end 13. Each second end would have an exterior circumference area adapted for engagement with a different style of socket which might be found in various electronic components to which the device 10 would be engaged. The void 23 could be included in one or more of the plurality of second ends 15. Also, the void 23 in one version of the provided second ends 15 could be dimensioned for a frictional engagement over a protruding component of the electronic device to which the device 10 is engaged such as an antenna 19. In kit form the user would assemble the plug 14 from a first end and second end and adapt it for engagement with the desired electronic device. The means of attachment for the first end to the second end could be any number of such means from a threaded engagement or snap-on frictional engagement or other conventional means of engagement of the first end to the second end.

Figure 4:
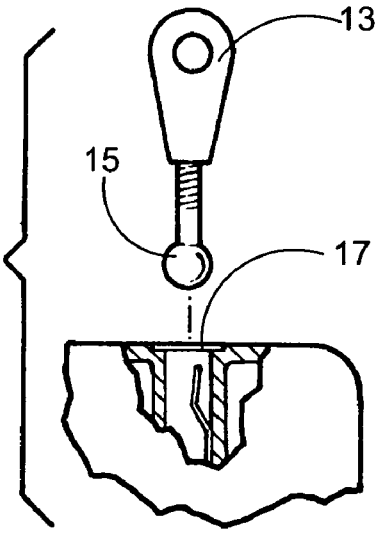
FIG. 4 depicts an embodiment of the device adapted for engagement with a conventional earphone port of an electronic device without engaging the cut off switch of the port and having removable second ends that can be provided in a kit.

FIG. 4 depicts a preferred embodiment of the device 10 showing a side view of a male version of a plug 14 designed to be in communication with earphone or other socket on an electronic device. It can be formed with or without the void 23 depending on the need for accommodating such a component in the socket. Also shown is the removable engagement of the second end 15 with the first end 13 by threaded engagement thereon or other means for cooperative engagement of the first end to the second.

As shown exploded from an earphone style socket 17 the bulbous end would allow for the second end 15 to engage in the socket 17 but allow the internal transacting switch to remain in an unengaged position thereby keeping the switch from disconnecting the speaker. This is accomplished by having the circumference of the bulbous distal end of the second end 15 being made to frictionally engage the sidewall of the socket 17 but the circumference of the rest of the second end bing sufficiently small to allow for the translating switch to move to the default position allowing the speaker to work. Of course this embodiment too would be made from rubber or silicone or other compressible material that is non conductive.

Figure 5:
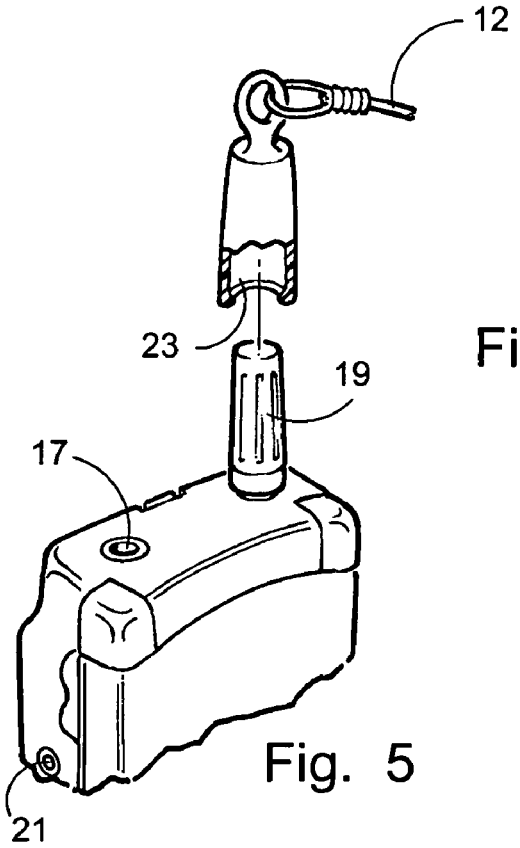
FIG. 5 depicts and embodiment of the device adapted for engagement over a protruding antenna of a cell phone or PDA.

FIG. 5 depicts another preferred embodiment of the device 10 which provides a version of the plug 14 adapted to facilitate frictional engagement over a protruding antenna or other stub-like extension of an electronic device. This embodiment has an axial void 23 in the second end, sized slightly smaller than the exterior circumference of the antenna 19. The first end 13 is adapted for engagement to a tether 12 as in the other embodiments. The material again would preferably be rubber, silicone, plastic, or some other non-conductive, elastic material to inhibit any electrical interference with the operation of the antenna 19. Further, such material would allow the axial void 23 to be stretched over the antenna 19 and thereby provide a biased engagement of the second end 15 with the antenna 19. As noted above, this embodiment of the second end 15 could be attachable to the first end 13 and provided in a kit form with other second ends 15 adapted for other sockets, or it could be provided as a fixed unit solely for engagement to protruding antennas 19 of electronic devices.

Although the invention has been described with respect to particular embodiments thereof, it should be realized that various changes and modifications may be made therein without departing from the spirit and scope of the invention. While the invention as shown in the drawings and described in detail herein discloses arrangements of elements of particular construction and configuration for illustrating preferred embodiments of structure and method of operation of the present invention, it is to be understood, however, that elements of different construction and configuration and other arrangements thereof, other than those illustrated and described, may be employed in accordance with the spirit of this invention. Any and all such changes, alternations and modifications, as would occur to those skilled in the art, are considered to be within the scope of this invention as broadly defined in the appended claims.

Further, the purpose of the attached abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application which is measured by the claims nor is it intended to be limiting as to the scope of the invention in any way.

What is claimed is:

1. A tether for electronic devices comprising:

a plug having a first end and a second end;

said first end engaged to a tether;

said second end having an exterior surface having an exterior circumference frictionally engageable with the interior circumference of an electrical socket communicating with the exterior surface of an electrical device;

said second end having an axial void extending therein and communicating with said second end;

said axial void engageable over an axial protrusion in said electrical socket;

said second end formed of compressible material;

said exterior circumference being slightly larger than said interior circumference of said socket thereby providing a means for a biased frictional engagement of said exterior circumference against said interior circumference;

said first end removably engageable to said second end;

a plurality of individual second ends provided in a kit;

each of said individual second ends adapted for said biased frictional engagement against a respective said interior circumference of a different electrical socket, and said second end being formed of non-conducive material, whereby said second end of said plug is engageable in said biased frictional engagement with said electrical socket in a nonconductive engagement and said first end is engaged to said tether to restrain said electrical device.

2. A tether for electronic devices comprising:

a plug having a first end and a second end;

said first end engaged to a tether;

said second end having an exterior surface having an exterior circumference frictionally engageable with the interior circumference of an electrical socket communicating with the exterior surface of an electrical device;

said second end being formed of non-conducive material, whereby said second end of said plug is frictionally engageable with said electrical socket in a non-conductive engagement and said first end is engaged to said tether to restrain said electrical device;

said exterior circumference of said second end located around a bulbous portion of said second end at a distal end of said second end;

a recess located between said first end and said bulbous portion;

said recess dimensioned to accommodate a transacting member in said electrical socket and allow said transacting member to translate to its closest position to the center axis of said electrical socket;

said second end having an axial void extending therein and communicating with said second end; and said axial void engageable over an axial protrusion in said electrical socket.

3. The tether for electronic devices of claim 2 further comprising:

said exterior circumference of said second end located around an elongated cylindrical portion of said second end at a distal end of said second end.

4. The tether for electronic devices of claim 3 further comprising:

said exterior surface of said second end is striated.

5. The tether for electronic devices of claim 2 further comprising:

said exterior surface of said second end is striated.

6. The tether for electronic devices of claim 2 further comprising:

said first end removably engageable to said second end;

a plurality of individual second ends provided in a kit; and each of said individual second ends adapted for frictional engagement within a different electrical socket.

7. A tether adapted for engagement with for electronic devices comprising:

a plug having a first end and a second end;

said first end engaged to a tether;

said second end having an exterior surface and having an axial cavity communicating with a distal end of said second end;

said second end formed of elastic non conductive material;

said axial cavity having a cavity circumference;

said cavity circumference being substantially less than the outside circumference of an antenna protruding from said electronic device;

said first end of said plug removably engageable with said second end of said plug;

a plurality of individual second ends of said plug provided in a kit of said second ends;

each of said plurality of second ends having an axial cavity circumference dimensioned for an engagement over a different sized outside circumference; and said axial cavity providing biased means of engagement to said outside circumference of said antenna.

8. A tether adapted for engagement with for electronic devices comprising:

a plug having a first end adapted for engagement with a tether and having a second end removably engageable with said first end;

said second end of said plug formed of non conductive material and adapted for a biased frictional engagement with one of an exterior circumference of a protruding antenna of an electrical device or a circumference of a surface of an internal socket of an electrical device communicating with the exterior of said electrical device;

said second end of said plug provided in a kit featuring a plurality of individual second ends; and each of said plurality of second ends adapted for engagement within a different sized internal socket or over a different sized protruding antenna, whereby the plug may be configured for adaptive engagement with a plurality of said electronic devices by engagement of different of said individual second ends to said first ends.

9. The tether adapted for engagement with for electronic devices of claim 8 additionally comprising:

said plug engaged at a first end to the first end of said tether;

said tether having a second end opposite said first end;

means of attachment of said second end of said tether to the clothing of a user; and said second end of said plug formed of non conductive material and adapted for said biased frictional engagement with one of a protruding antenna of an electrical device or an internal socket of an electrical device communicating with the exterior of said electrical device.

10. The tether for electronic devices of claim 9 further comprising:

said second end formed of compressible material; and said exterior circumference being slightly larger than said interior circumference of said socket thereby providing said biased frictional engagement of said exterior circumference with said interior circumference.

11. The tether adapted for engagement with for electronic devices of claim 9 additionally comprising:

said second end of said plug, if adapted for engagement with a protruding antenna of an electrical device, having an exterior surface and having an axial cavity communicating with a distal end of said second end;

said second end formed of elastic non conductive material;

said axial cavity having a cavity circumference; and said cavity circumference being substantially less than, the outside circumference of said antenna protruding from said electronic device, whereby said axial cavity will engage there over in said biased engagement.

* * * * *